US008222983B2

(12) United States Patent
Zhou et al.

(10) Patent No.: US 8,222,983 B2
(45) Date of Patent: Jul. 17, 2012

(54) SINGLE DIRECT CURRENT ARC CHAMBER, AND BI-DIRECTIONAL DIRECT CURRENT ELECTRICAL SWITCHING APPARATUS EMPLOYING THE SAME

(75) Inventors: Xin Zhou, Franklin Park, PA (US); Mark A. Juds, New Berlin, WI (US); Naresh K. Kodela, Maharashtra (IN); William E. Beatty, Jr., Beaver Brighton, PA (US)

(73) Assignee: Eaton Corporation, Cleveland, OH (US)

( * ) Notice: Subject to any disclaimer, the term of this patent is extended or adjusted under 35 U.S.C. 154(b) by 125 days.

(21) Appl. No.: 12/962,711

(22) Filed: Dec. 8, 2010

(65) Prior Publication Data

US 2012/0145675 A1 Jun. 14, 2012

(51) Int. Cl.
*H01H 9/30* (2006.01)

(52) U.S. Cl. ..... 335/201; 218/26; 218/150

(58) Field of Classification Search ..... 218/24–26, 218/150–151; 335/201
See application file for complete search history.

(56) References Cited

U.S. PATENT DOCUMENTS

| | | | | |
|---|---|---|---|---|
| 4,375,021 | A * | 2/1983 | Pardini et al. | 218/25 |
| 4,743,720 | A * | 5/1988 | Takeuchi et al. | 218/24 |
| 5,004,874 | A | 4/1991 | Theisen et al. | |
| 5,130,504 | A | 7/1992 | Moldovan et al. | |
| 7,541,902 | B2 * | 6/2009 | Domejean et al. | 335/201 |
| 7,679,020 | B2 * | 3/2010 | Schulz et al. | 218/26 |
| 7,839,243 | B1 * | 11/2010 | Chen et al. | 335/201 |

FOREIGN PATENT DOCUMENTS

| | | |
|---|---|---|
| DE | 10 07 409 B | 5/1957 |
| DE | 11 40 997 B | 12/1962 |
| DE | 12 46 851 B | 8/1967 |
| DE | 20 2005 007878 U1 | 9/2006 |

OTHER PUBLICATIONS

Siemens Industry, Inc., "Heavy Duty Photovoltaic Disconnect Switches", www.usa.siemens.com/switches, 2010, 4pp.
Tyco Electronics, "Kilovac EV250-1A & 1B—400 Amps ("Czonka II EVX")", www.tycoelectronics.com, 2010, pp. 16 and 19.
European Patent Office, "extended European search report", Mar. 23, 2012, 6 pp.

* cited by examiner

*Primary Examiner* — Truc Nguyen
(74) *Attorney, Agent, or Firm* — Eckert Seamans Cherin & Mellott, LLC; Kirk D. Houser

(57) ABSTRACT

A single direct current arc chamber includes a ferromagnetic base having first and opposite second ends, a first ferromagnetic side member disposed from the first end, a second ferromagnetic side member disposed from the opposite second end, a third ferromagnetic member disposed from the ferromagnetic base intermediate the ferromagnetic side members, a first permanent magnet having a first magnetic polarity disposed on the first ferromagnetic side member and facing the third ferromagnetic member, and a second permanent magnet having the first magnetic polarity disposed on the second ferromagnetic side member and facing the third ferromagnetic member.

21 Claims, 7 Drawing Sheets

FIG. 7
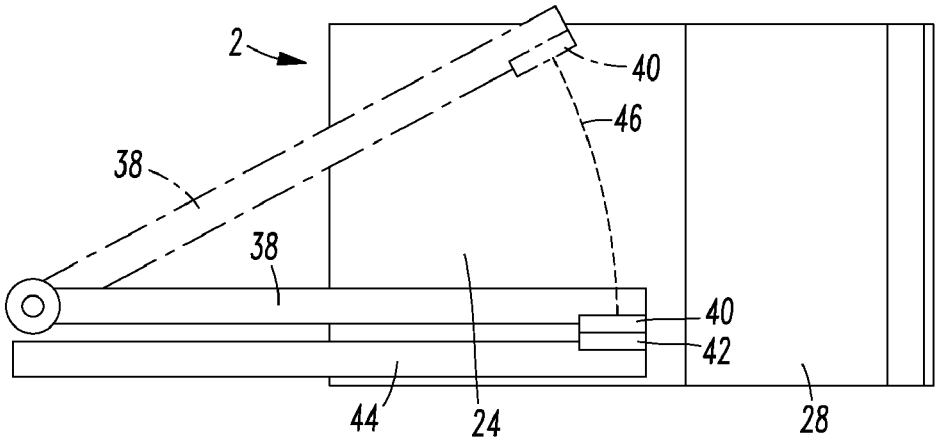
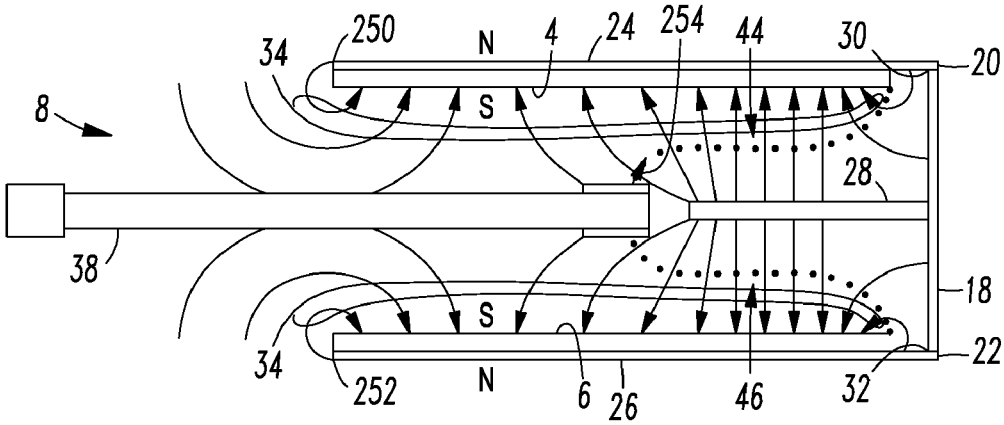
FIG. 8

SINGLE DIRECT CURRENT ARC CHAMBER, AND BI-DIRECTIONAL DIRECT CURRENT ELECTRICAL SWITCHING APPARATUS EMPLOYING THE SAME

BACKGROUND

1. Field

The disclosed concept pertains generally to electrical switching apparatus and, more particularly, to direct current electrical switching apparatus, such as, for example, direct current circuit breakers. The disclosed concept further pertains to direct current arc chambers.

2. Background Information

Electrical switching apparatus employing separable contacts exposed to air can be structured to open a power circuit carrying appreciable current. These electrical switching apparatus, such as, for instance, circuit breakers, typically experience arcing as the contacts separate and commonly incorporate arc chambers, such as arc chutes, to help extinguish the arc. Such arc chutes typically comprise a plurality of electrically conductive plates held in spaced relation around the separable contacts by an electrically insulative housing. The arc transfers to the arc plates where it is stretched and cooled until extinguished.

Known molded case circuit breakers (MCCBs) are not specifically designed for use in direct current (DC) applications. When known alternating current (AC) MCCBs are sought to be applied in DC applications, multiple poles are electrically connected in series to achieve the required interruption or switching performance based upon the desired system DC voltage and system DC current.

One of the challenges in DC current interruption/switching, especially at a relatively low DC current, is to drive the arc into the arc interruption chamber. Known DC electrical switching apparatus employ permanent magnets to drive the arc into arc splitting plates. Known problems associated with such permanent magnets in known DC electrical switching apparatus include unidirectional operation of the DC electrical switching apparatus, and two separate arc chambers each including a plurality of arc plates and a set of contacts must be employed to provide bi-directional operation. These problems make it very difficult to implement a permanent magnet design for a typical DC MCCB without a significant increase in size and cost.

There is room for improvement in direct current electrical switching apparatus.

There is also room for improvement in direct current arc chambers.

SUMMARY

These needs and others are met by embodiments of the disclosed concept, which provide an electrical switching apparatus with a permanent magnet arrangement and single break operation to achieve bi-directional DC switching and interruption.

For example, two permanent magnet plates are employed along both sides of a single arc chamber including a single set of a plurality of arc plates and a permanent magnet or ferromagnetic center barrier to provide a dual arc chamber structure. The resulting magnetic field drives the arc into one side of the dual arc chamber structure and splits the arc accordingly depending upon the direction of the DC current.

In accordance with one aspect of the disclosed concept, a single direct current arc chamber comprises: a ferromagnetic base having a first end and an opposite second end; a first ferromagnetic side member disposed from the first end of the ferromagnetic base; a second ferromagnetic side member disposed from the opposite second end of the ferromagnetic base; a third ferromagnetic member disposed from the ferromagnetic base intermediate the first and second ferromagnetic side members; a first permanent magnet having a first magnetic polarity disposed on the first ferromagnetic side member and facing the third ferromagnetic member; and a second permanent magnet having the first magnetic polarity disposed on the second ferromagnetic side member and facing the third ferromagnetic member.

The first end of the ferromagnetic base and the first ferromagnetic side member disposed from the first end of the ferromagnetic base may define a first corner; the opposite second end of the ferromagnetic base and the second ferromagnetic side member disposed from the opposite second end of the ferromagnetic base may define a second corner; the single direct current arc chamber may define a magnetic field pattern; an arc may be struck between the first and second ferromagnetic side members; and the magnetic field pattern may be structured to drive the arc toward one of the first and second corners depending on a direction of current flowing in the arc.

The first and second ferromagnetic side members may have a first length; the third ferromagnetic member may have a second smaller length; and a ratio of the first length to the second smaller length may be greater than a predetermined value, which is greater than 1.0.

The predetermined value may be about 1.33.

As another aspect of the disclosed concept, a single direct current arc chamber comprises: a ferromagnetic base having a first end and an opposite second end; a first ferromagnetic side member disposed from the first end of the ferromagnetic base; a second ferromagnetic side member disposed from the opposite second end of the ferromagnetic base; a third ferromagnetic member disposed from the ferromagnetic base intermediate the first and second ferromagnetic side members; a first permanent magnet having a first magnetic polarity disposed on the first ferromagnetic side member and facing the third ferromagnetic member; a second permanent magnet having the first magnetic polarity disposed on the second ferromagnetic side member and facing the third ferromagnetic member; a third permanent magnet having an opposite second magnetic polarity disposed on the third ferromagnetic member and facing the first permanent magnet having the first magnetic polarity; and a fourth permanent magnet having the opposite second magnetic polarity disposed on the third ferromagnetic member and facing the second permanent magnet having the first magnetic polarity.

As another aspect of the disclosed concept, a bi-directional, direct current electrical switching apparatus comprises: separable contacts; an operating mechanism structured to open and close the separable contacts; and a single direct current arc chamber comprising: a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, a first permanent magnet having a first magnetic polarity disposed on the first ferromagnetic side member and facing the third ferromagnetic member, and a second permanent magnet having the first magnetic polarity disposed on the second ferromagnetic side member and facing the third ferromagnetic member.

The first end of the ferromagnetic base and the first ferromagnetic side member disposed from the first end of the ferromagnetic base may define a first corner; the opposite second end of the ferromagnetic base and the second ferromagnetic side member disposed from the opposite second end of the ferromagnetic base may define a second corner; the single direct current arc chamber may define a magnetic field pattern; opening of the separable contacts may cause an arc to be struck between the first and second ferromagnetic side members; and the magnetic field pattern may be structured to drive the arc toward one of the first and second corners depending on a direction of current flowing between the separable contacts.

A magnetic field strength of the magnetic field pattern may be at least about 30 mT.

BRIEF DESCRIPTION OF THE DRAWINGS

A full understanding of the disclosed concept can be gained from the following description of the preferred embodiments when read in conjunction with the accompanying drawings in which:

FIG. 7 is a simplified vertical elevation view of the steel and permanent magnet structure of FIG. 1B and also including a movable contact arm and separable contacts in an open position.

FIG. 8 is a simplified top plan view of the steel and permanent magnet structure, the movable contact arm and the separable contacts of FIG. 7.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a three-pole circuit breaker, although the disclosed concept is applicable to a wide range of electrical switching apparatus having any number of poles.

Figure 1A:
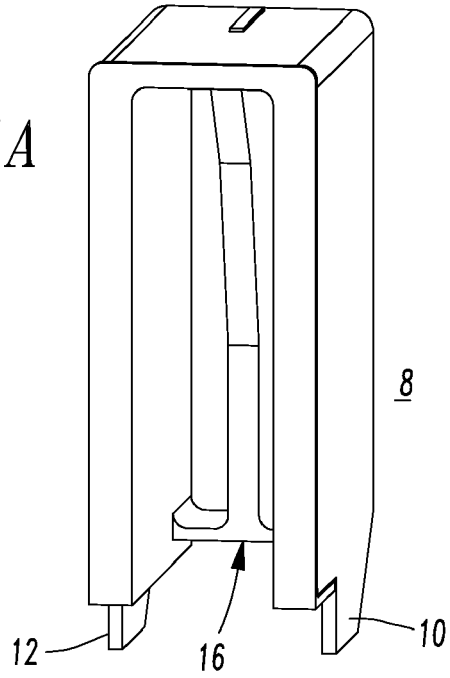
FIGS. 1A and 1B are respective front and rear isometric views of a steel and permanent magnet structure including two permanent magnets for a single arc chamber in accordance with embodiments of the disclosed concept.
Figure 1B:
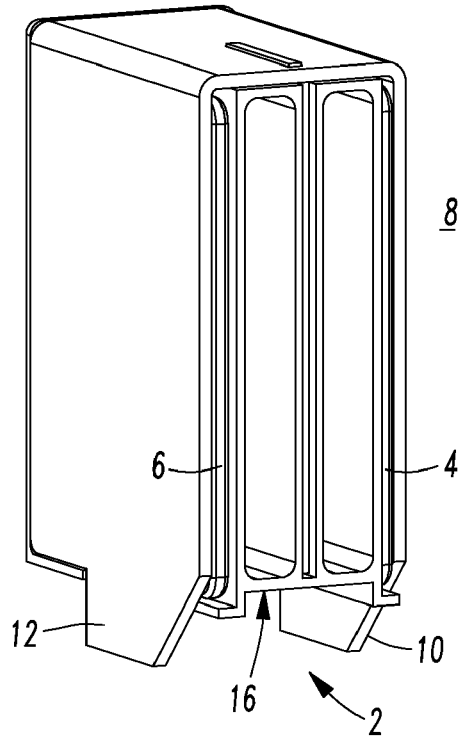
Figure 3:
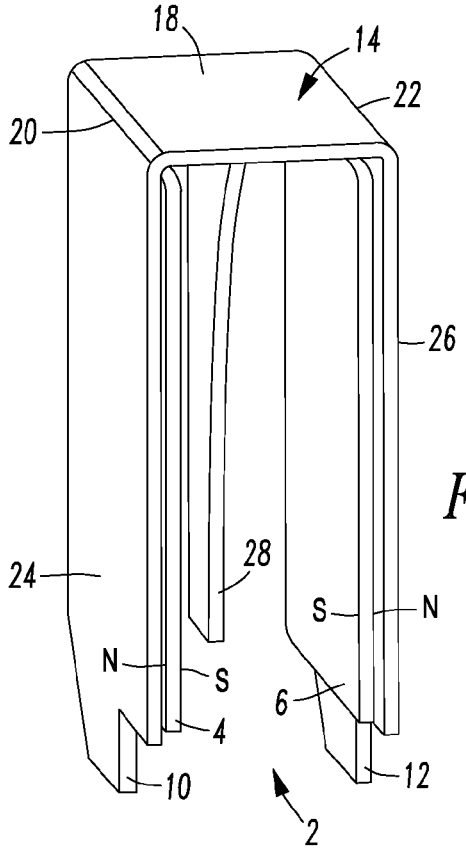
FIG. 3 is an isometric view of the steel and permanent magnet structure of FIG. 1B.

Referring to FIGS. 1A, 1B and 3, a steel and permanent magnet structure 2 includes two permanent magnets 4,6 for a single direct current arc chamber 8. The permanent magnets 4,6 are shown just inside of the two vertical legs 10,12 of the steel structure 14 in FIG. 3, and are between the steel structure 14 and an insulative housing 16 of FIG. 1B. As best shown in FIG. 3, the single direct current arc chamber 8 (as shown in FIGS. 1A and 1B) includes a ferromagnetic base 18 having a first end 20 and an opposite second end 22. A first ferromagnetic side member 24 is disposed from the first end 20, a second ferromagnetic side member 26 is disposed from the opposite second end 22, and a third ferromagnetic member 28 is disposed from the ferromagnetic base 18 intermediate the first and second ferromagnetic side members 24,26. The first permanent magnet 4 has a first magnetic polarity (S), is disposed on the first ferromagnetic side member 24 and faces the third ferromagnetic member 28. The second permanent magnet 6 has the first magnetic polarity (S), is disposed on the second ferromagnetic side member 26 and faces the third ferromagnetic member 28.

EXAMPLE 1

Also referring to FIGS. 7 and 8, the first end 20 of the ferromagnetic base 18 and the first ferromagnetic side member 24 disposed from the first end 20 define a first corner 30, and the opposite second end 22 of the ferromagnetic base 18 and the second ferromagnetic side member 26 disposed from the opposite second end 22 define a second corner 32. The single direct current arc chamber 8 defines a magnetic field pattern 34. A movable contact arm 38 carries a movable contact 40, which electrically engages a fixed contact 42 carried by a stationary conductor 44. Whenever an arc 46 is struck between the movable contact 40 and the fixed contact 42, which are disposed between the first and second ferromagnetic side members 24,26, the magnetic field pattern 34 is structured to drive the arc toward one of the first and second corners 30,32 depending on a direction of current flowing in the arc 46. For example, for current flowing from the movable contact 40 to the fixed contact 42, the arc is driven toward the corner 30 along path 44. Conversely, for current flowing from the fixed contact 42 to the movable contact 40, the arc is driven toward the corner 32 along path 46.

Here, unlike FIG. 2, which is discussed below, the center third ferromagnetic (e.g., steel) member 28 does not have additional permanent magnets.

EXAMPLE 2

Figure 2:
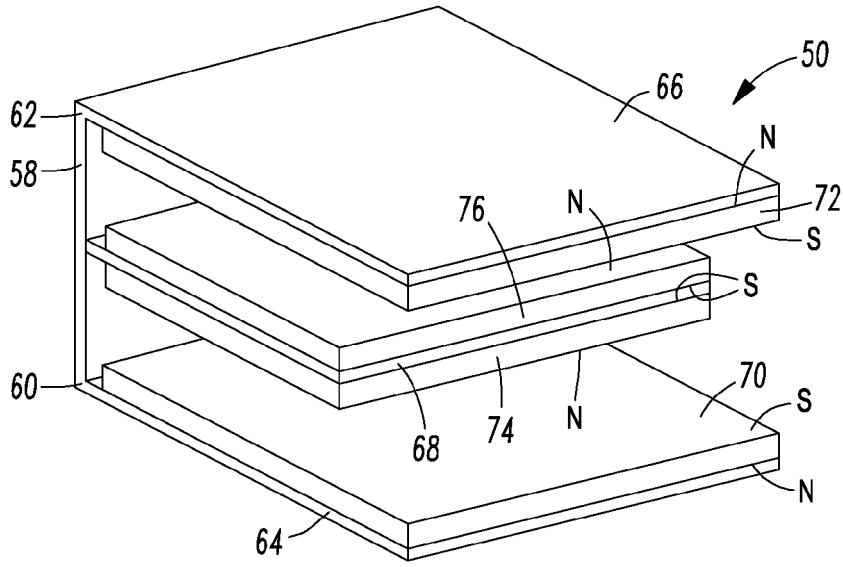
FIG. 2 is an isometric view of a steel and permanent magnet structure including four permanent magnets in accordance with another embodiment of the disclosed concept.

Referring to FIG. 2, another single direct current arc chamber 50 includes a ferromagnetic base 58 having a first end 60 and an opposite second end 62, a first ferromagnetic side member 64 disposed from the first end 60, a second ferromagnetic side member 66 disposed from the opposite second end 62, and a third ferromagnetic member 68 disposed from the ferromagnetic base 58 intermediate the first and second ferromagnetic side members 64,66. A first permanent magnet 70 has a first magnetic polarity (S), is disposed on the first ferromagnetic side member 64 and faces the third ferromagnetic member 68. A second permanent magnet 72 has the first magnetic polarity (S), is disposed on the second ferromagnetic side member 66 and faces the third ferromagnetic member 68. A third permanent magnet 74 has an opposite second magnetic polarity (N), is disposed on the third ferromagnetic member 68 and faces the first permanent magnet 70 having the first magnetic polarity (S). A fourth permanent magnet 76 has the opposite second magnetic polarity (N), is disposed on the third ferromagnetic member 68 and faces the second permanent magnet 72 having the first magnetic polarity (S).

The magnetic field can be increased by increasing the thickness of the permanent magnets 70,72,74,76 and increasing the thickness of the ferromagnetic members 64,66,68. If the ferromagnetic members are magnetically saturated, then the magnetic field can be increased by increasing the thickness of the ferromagnetic members 70,72,74,76 alone. If the ferromagnetic members are not magnetically saturated, then the magnetic field can be increased by increasing the thickness of the permanent magnets 70,72,74,76 alone.

EXAMPLE 3

Figure 5:
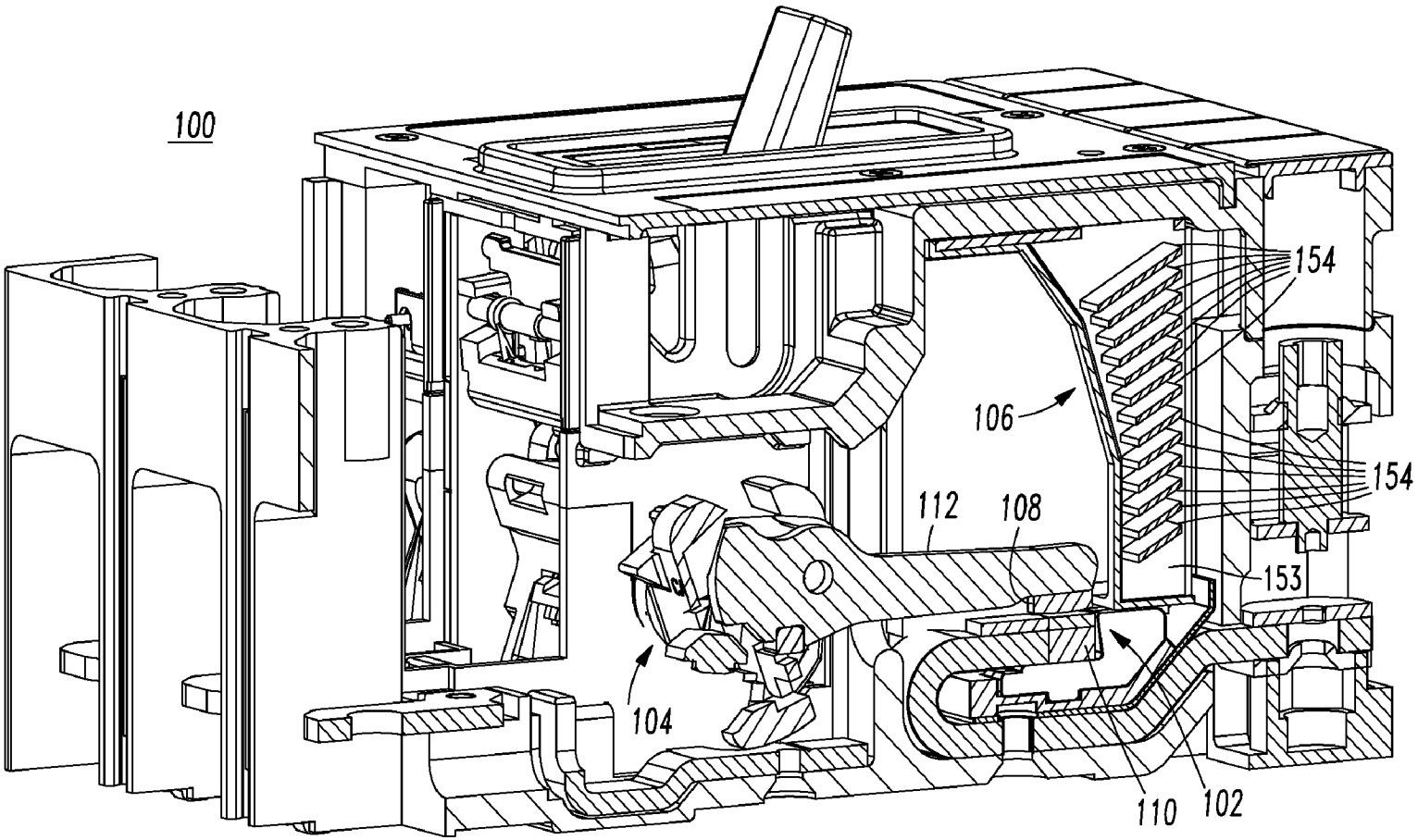
FIGS. 5 and 6 are isometric views of an electrical switching apparatus with some parts cut away to show internal structures in closed and open positions, respectively, in accordance with embodiments of the disclosed concept.
Figure 6:
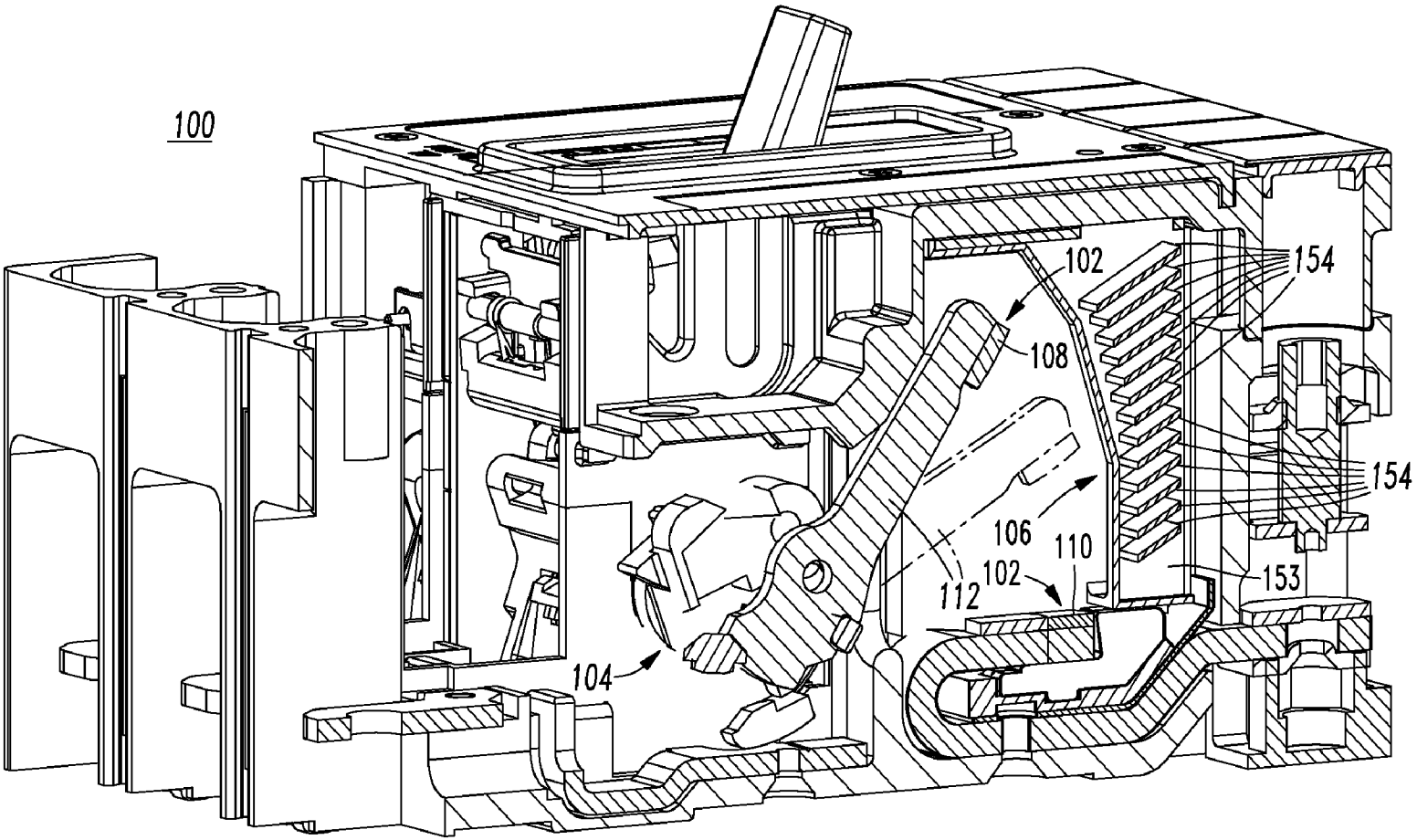

FIG. 5 (closed position) and FIG. 6 (open position) show a bi-directional, direct current electrical switching apparatus 100 including separable contacts 102, an operating mechanism 104 structured to open and close the separable contacts 102, and a single direct current arc chamber 106, which may be the same as or similar to the single direct current arc chamber 8 (FIG. 1B) or the single direct current arc chamber 50 (FIG. 2). FIG. 6 shows the separable contacts 102 (shown in phantom line drawing in a partially open position, which corresponds to the partially open position in FIG. 7).

The separable contacts 102 include a movable contact 108 and a fixed contact 110. The operating mechanism 104 includes a movable contact arm 112 carrying the movable contact 108 with respect to the single direct current arc chamber 106.

EXAMPLE 4

Referring again to FIGS. 2 and 3, the ferromagnetic bases 18 and 58 and the respective first, second and third ferromagnetic members 24,26,28 and 64,66,68 are made of soft magnetic steel (e.g., without limitation, 1010 steel).

EXAMPLE 5

The ferromagnetic bases 18 and 58 and the respective first, second and third ferromagnetic members 24,26,28 and 64,66,68 form E-shaped ferromagnetic structures.

EXAMPLE 6

The E-shaped ferromagnetic structures of Example 5 are made of soft magnetic steel (e.g., without limitation, 1010 steel).

EXAMPLE 7

The first and second permanent magnets 4,6 and 70,72 are selected from the group consisting of high energy permanent magnets (e.g., without limitation, a Neodymium Iron Boron (Sintered) N2880 material, and a Samarium Cobalt (Sintered) S2869 material).

The third and fourth permanent magnets 74,76 are selected from the group consisting of high energy permanent magnets (e.g., without limitation, a Neodymium Iron Boron (Sintered) N2880 material, and a Samarium Cobalt (Sintered) S2869 material).

EXAMPLE 8

A magnetic field strength of the magnetic field pattern 34 of FIG. 8 is preferred to be at least about 30 mT.

EXAMPLE 9

Figure 4A:
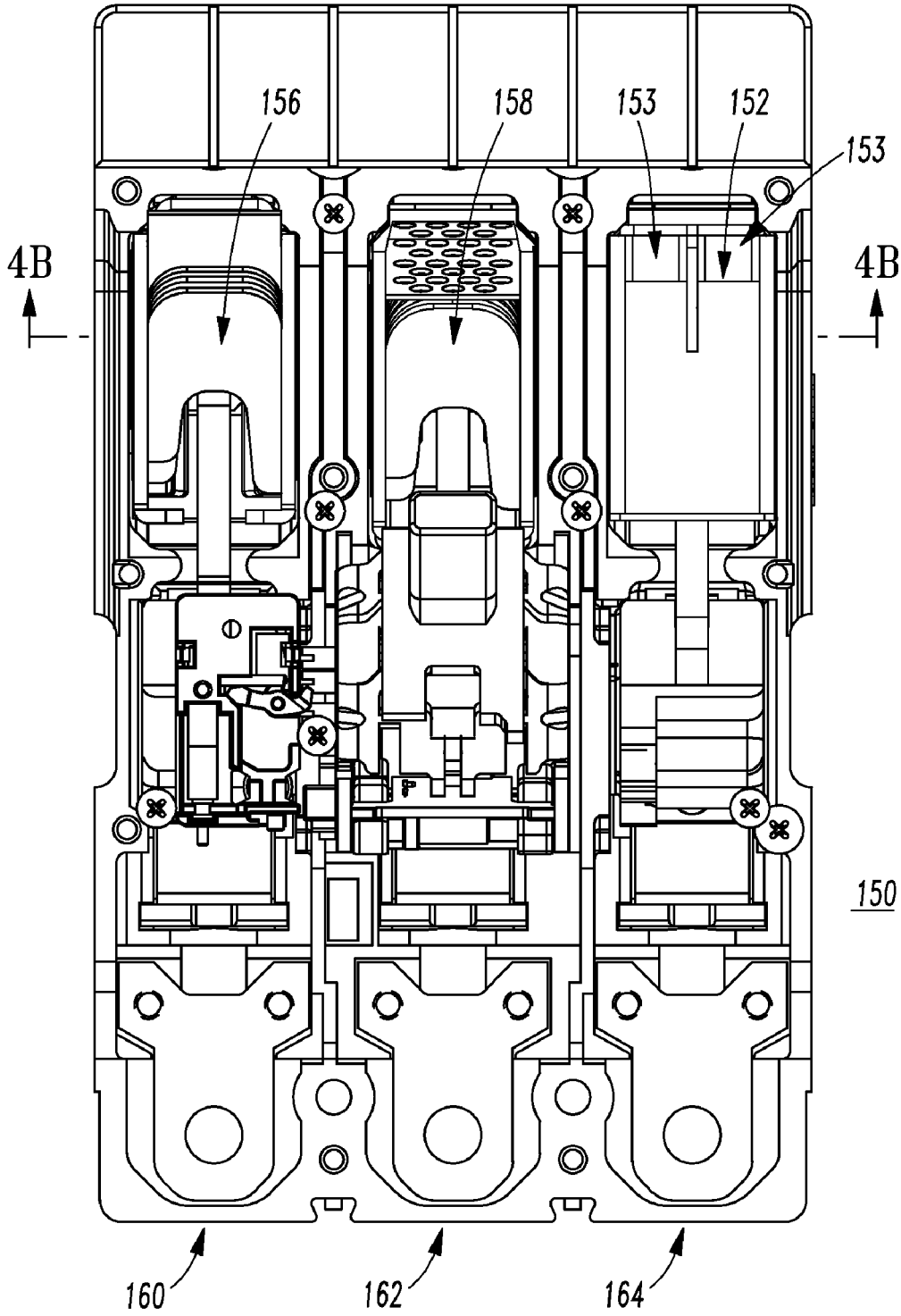
FIG. 4A is a top plan view of a circuit interrupter including an arc chamber in accordance with embodiments of the disclosed concept.
Figure 4B:
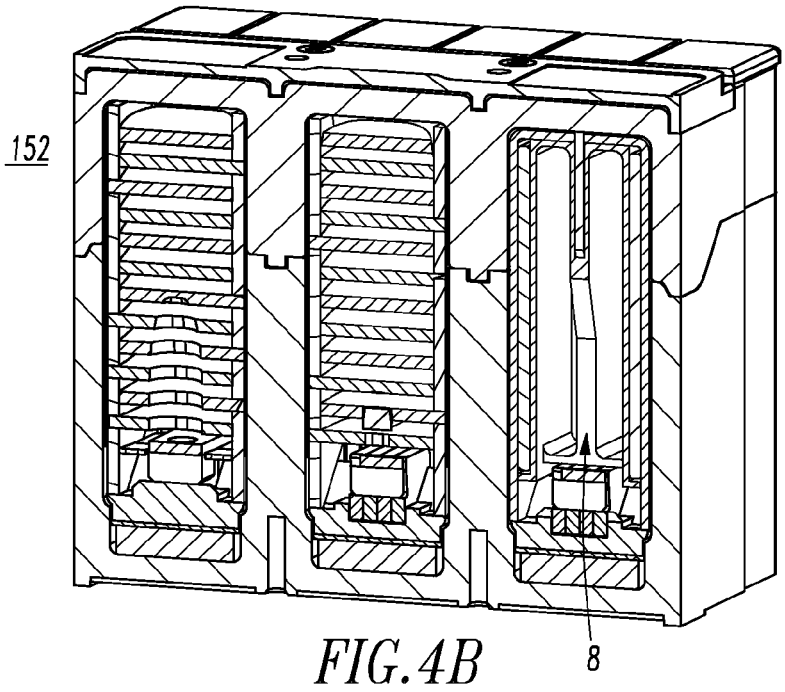
FIG. 4B is a cross sectional isometric view of the arc chamber of FIG. 4A along lines 4B-4B thereof.

FIG. 4A shows a circuit interrupter 150 including an arc chamber 152 in accordance with embodiments of the disclosed concept. The single direct current arc chamber 152 includes a single set or a double set (one set in each side for the dual arc chamber) of a plurality of arc plates 154. For example and without limitation, FIG. 4A shows two arc chutes 153 in arc chamber 152, each of which includes a plurality of arc plates (not shown, but see arc plates 154 of FIG. 6). In FIG. 4A, the cover (not shown) is removed. In FIGS. 4A and 4B, there are two different conventional AC arc chamber configurations 156,158 in the left and center poles 160,162 of the circuit interrupter 150. The right pole 164 is the DC arc chamber 152 in accordance with the disclosed concept.

EXAMPLE 10

Figure 9:
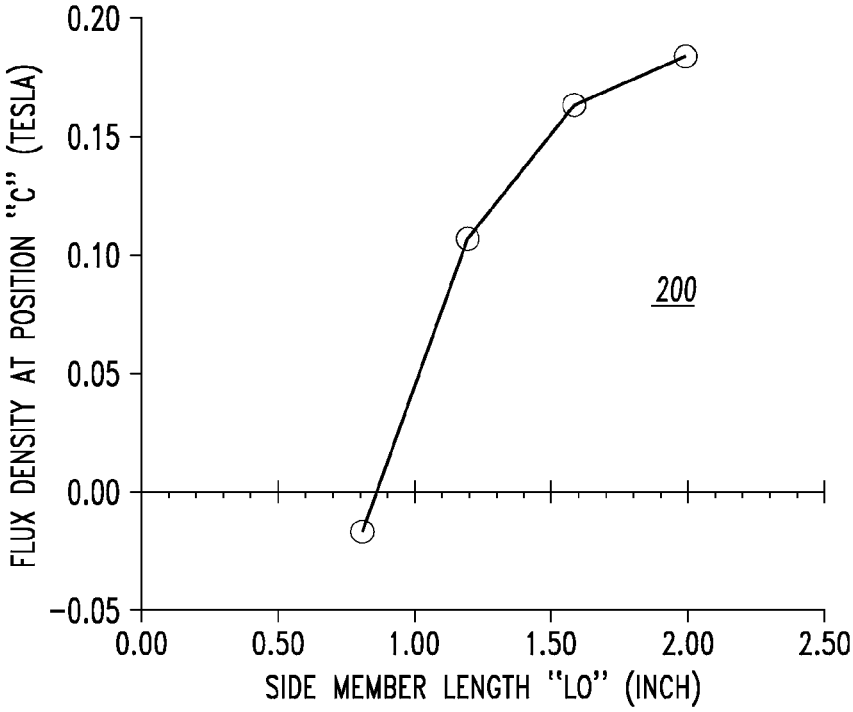
FIG. 9 is a plot of flux density versus outside length of the steel and permanent magnet structure of FIG. 7.

FIG. 9 shows a plot 200 of flux density versus outside length (Lo) of the steel and permanent magnet structure 2 of FIG. 7. With reference to FIGS. 7 and 8, the first and second ferromagnetic side members 24,26 have a first length (Lo), which in this example is greater than about 1 inch. The third ferromagnetic intermediate member 28 has a second smaller length (Li). A ratio of the first length (Lo) to the second smaller length (Li) is greater than a predetermined value, which is greater than 1.0. Preferably, the predetermined value is about 1.33. Here, the magnetic field strength of the magnetic field pattern 34 in the path of an arc is at least about 30 mT.

EXAMPLE 11

The following discusses the causes of directing an arc to one side of the single DC arc chamber 8 for one DC polarity, and directing the arc to the other side of the single DC arc chamber 8 for the other opposite DC polarity. Here, the positive or negative current direction interacts with the established magnetic fields.

Referring to FIGS. 1A, 3, and 7-9, with the inside length (Li) (e.g., without limitation, 0.6 inch; any suitable length) of the steel structure 14 and other parameters being fixed, the outside length Lo has to be long enough in order that the magnetic field (of magnetic field pattern 34) at the movable contact location (e.g., corresponding to the partially open position of the separable contacts 40,42 (shown in phantom line drawing in FIG. 7)) right in front of the center partition steel 28 is pointing away from the arc chamber direction. This means that the ratio of Lo/Li has to be large enough as shown in FIG. 9, which plots flux density versus Lo.

When Lo is at about 0.8", the magnetic field points towards the arc chamber direction. In this case, the magnetic field pattern 34 at the contact location will look like the magnetic field pattern close to the corners 250 and 252. This magnetic field will drive the arc towards either corner 250 or corner 252 depending on the current direction.

However, when Lo is above about 1", the magnetic field points away from the arc chamber direction. In this case, the magnetic field pattern 34 at the contact location will look like what is shown in FIG. 8, and will drive the arc towards either corner 30 or corner 32 depending on the current direction.

Hence, the ratio of Lo/Li has to be large enough. In FIG. 9, Li is fixed as Lo changes. In this case, FIG. 9 can be regarded as a Lo/Li plot 200 just by changing the Lo axis values (divided by Li).

In summary, the ratio of Lo/Li has to be greater than a predetermined value. The magnetic field value is preferably in the range of 30 mT or higher so that it can drive the arc at relatively low current levels.

EXAMPLE 12

A DC electric arc in FIG. 8 initially follows the current flowing into the drawing sheet. The Loentz force on the arc is indicated at 254, and the path of movement of the arc is at 44. When the DC electrical switching apparatus separable contacts 40,42 open, the arc needs to be suitably moved, in order that it can be extinguished. Therefore, the flux arrows are preferably more vertical, like they are at position 254, with magnitude of about 30 mT.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A single direct current arc chamber comprising:

a ferromagnetic base having a first end and an opposite second end;

a first ferromagnetic side member disposed from the first end of the ferromagnetic base;

a second ferromagnetic side member disposed from the opposite second end of the ferromagnetic base;

a third ferromagnetic member disposed from the ferromagnetic base intermediate the first and second ferromagnetic side members;

a first permanent magnet having a first magnetic polarity disposed on the first ferromagnetic side member and facing the third ferromagnetic member; and a second permanent magnet having the first magnetic polarity disposed on the second ferromagnetic side member and facing the third ferromagnetic member.

2. The single direct current arc chamber of claim 1 wherein said ferromagnetic base, said first and second ferromagnetic side members and said third ferromagnetic member form an E-shaped ferromagnetic structure.

3. The single direct current arc chamber of claim 1 wherein the first end of said ferromagnetic base and said first ferromagnetic side member disposed from the first end of said ferromagnetic base define a first corner; wherein the opposite second end of said ferromagnetic base and said second ferromagnetic side member disposed from the opposite second end of said ferromagnetic base define a second corner; wherein said single direct current arc chamber defines a magnetic field pattern; wherein an arc is struck between said first and second ferromagnetic side members; and wherein said magnetic field pattern is structured to drive the arc toward one of the first and second corners depending on a direction of current flowing in said arc.

4. The single direct current arc chamber of claim 3 wherein a magnetic field strength of said magnetic field pattern is at least about 30 mT.

5. The single direct current arc chamber of claim 1 wherein said first and second ferromagnetic side members have a first length; wherein said third ferromagnetic member has a second smaller length; and wherein a ratio of the first length to the second smaller length is greater than a predetermined value, which is greater than 1.0.

6. The single direct current arc chamber of claim 1 wherein said predetermined value is about 1.33.

7. A single direct current arc chamber comprising:

a ferromagnetic base having a first end and an opposite second end;

a first ferromagnetic side member disposed from the first end of the ferromagnetic base;

a second ferromagnetic side member disposed from the opposite second end of the ferromagnetic base;

a third ferromagnetic member disposed from the ferromagnetic base intermediate the first and second ferromagnetic side members;

a first permanent magnet having a first magnetic polarity disposed on the first ferromagnetic side member and facing the third ferromagnetic member;

a second permanent magnet having the first magnetic polarity disposed on the second ferromagnetic side member and facing the third ferromagnetic member;

a third permanent magnet having an opposite second magnetic polarity disposed on the third ferromagnetic member and facing the first permanent magnet having the first magnetic polarity; and a fourth permanent magnet having the opposite second magnetic polarity disposed on the third ferromagnetic member and facing the second permanent magnet having the first magnetic polarity.

8. The single direct current arc chamber of claim 7 wherein said third and fourth permanent magnets are selected from the group consisting of a Neodymium Iron Boron N2880 material, and a Samarium Cobalt S2869 material.

9. A bi-directional, direct current electrical switching apparatus comprising:

separable contacts;

an operating mechanism structured to open and close said separable contacts; and a single direct current arc chamber comprising:

a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, a first permanent magnet having a first magnetic polarity disposed on the first ferromagnetic side member and facing the third ferromagnetic member, and a second permanent magnet having the first magnetic polarity disposed on the second ferromagnetic side member and facing the third ferromagnetic member.

10. The bi-directional, direct current electrical switching apparatus of claim 9 wherein said ferromagnetic base, said first and second ferromagnetic side members, and said third ferromagnetic member are made of soft magnetic steel.

11. The bi-directional, direct current electrical switching apparatus of claim 9 wherein said ferromagnetic base, said first and second ferromagnetic side members, and said third ferromagnetic member form an E-shaped ferromagnetic structure.

12. The bi-directional, direct current electrical switching apparatus of claim 11 wherein said E-shaped ferromagnetic structure is made of soft magnetic steel.

13. The bi-directional, direct current electrical switching apparatus of claim 9 wherein said first and second permanent magnets are selected from the group consisting of a Neodymium Iron Boron N2880 material and a Samarium Cobalt S2869 material.

14. The bi-directional, direct current electrical switching apparatus of claim 9 wherein said single direct current arc chamber further comprises a single set of a plurality of arc plates.

15. The bi-directional, direct current electrical switching apparatus of claim 9 wherein said separable contacts comprise a movable contact and a fixed contact; and wherein said operating mechanism comprises a movable contact arm carrying said movable contact with respect to said single direct current arc chamber.

16. The bi-directional, direct current electrical switching apparatus of claim 9 wherein the first end of said ferromagnetic base and said first ferromagnetic side member disposed from the first end of said ferromagnetic base define a first corner; wherein the opposite second end of said ferromagnetic base and said second ferromagnetic side member disposed from the opposite second end of said ferromagnetic base define a second corner; wherein said single direct current arc chamber defines a magnetic field pattern; wherein opening of said separable contacts causes an arc to be struck between said first and second ferromagnetic side members; and wherein said magnetic field pattern is structured to drive the arc toward one of the first and second corners depending on a direction of current flowing between said separable contacts.

17. The bi-directional, direct current electrical switching apparatus of claim 16 wherein a magnetic field strength of said magnetic field pattern is at least about 30 mT.

18. The bi-directional, direct current electrical switching apparatus of claim 16 wherein said first and second ferromagnetic side members have a first length, wherein said third ferromagnetic member has a second smaller length; and wherein a ratio of the first length to the second smaller length is greater than a predetermined value, which is greater than 1.0.

19. The bi-directional, direct current electrical switching apparatus of claim 18 wherein said predetermined value is about 1.33.

20. The bi-directional, direct current electrical switching apparatus of claim 9 wherein a third permanent magnet having an opposite second magnetic polarity is disposed on the third ferromagnetic member and facing the first permanent magnet having the first magnetic polarity; and wherein a fourth permanent magnet having the opposite second magnetic polarity is disposed on the third ferromagnetic member and facing the second permanent magnet having the first magnetic polarity.

21. The bi-directional, direct current electrical switching apparatus of claim 20 wherein said third and fourth permanent magnets are selected from the group consisting of a Neodymium Iron Boron N2880 material, and a Samarium Cobalt S2869 material.

* * * * *